US007189119B2

(12) United States Patent
Blichasz et al.

(10) Patent No.: US 7,189,119 B2
(45) Date of Patent: Mar. 13, 2007

(54) ADAPTER HAVING TRANSIENT SUPPRESSION PROTECTION

(75) Inventors: Charles Blichasz, Boiling Springs, PA (US); Michael A. Yeomans, Camp Hill, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/988,652

(22) Filed: Nov. 15, 2004

(65) Prior Publication Data

US 2006/0105635 A1 May 18, 2006

(51) Int. Cl.
*H01R 25/00* (2006.01)

(52) U.S. Cl. ..... 439/638; 439/676; 439/540.1

(58) Field of Classification Search ..... 439/541.5, 439/638, 676, 76.1, 620, 620.11
See application file for complete search history.

(56) References Cited

U.S. PATENT DOCUMENTS 4,726,638 A 2/1988 Farrar et al.
4,799,901 A 1/1989 Pirc
6,848,943 B2 * 2/2005 Machado et al. ..... 439/607

* cited by examiner

*Primary Examiner*—Javaid H. Nasri
(74) *Attorney, Agent, or Firm*—Wei Te Chung

(57) ABSTRACT

An electrical adapter (100) includes a first housing member (1), a second housing member (2) coupled with the first housing member to define an internal space therebetween, and a subassembly (3) received in the space. The first housing member has a first mating face (11) defining a first upper and lower cavities (111, 112). The second housing member has a second mating face (21) defining a second cavity (211). The subassembly includes a first, second and third circuit boards (311, 321, 331), a surge suppressing device (34), a number of first, second and third conductive terminals (312, 322, 332) respectively mounted on the first, second and third circuit boards, and a number of contact vias (35) electrically connecting with corresponding first, second and third terminals. The first, second and third terminals respectively have contacting portions (314, 324, 334) extending into corresponding cavities. The surge suppressing device is mounted on the first circuit boards and electrically connects with corresponding first, second and third terminals for transient voltage protection via the contact vias.

7 Claims, 8 Drawing Sheets

ADAPTER HAVING TRANSIENT SUPPRESSION PROTECTION

CROSS-REFERENCE TO RELATED APPLICATION

This application is related to a U.S. patent application with Ser. No. 10/794,127 entitled "ELECTRICAL CONNECTOR HAVING SURGE SUPPRESSING DEVICE", invented by the same inventor and assigned to the common assignee as the present invention.

BACKGROUND OF THE INVENTION

1. Field of the Invention

The present invention relates to electrical connectors and more particularly to adapters for providing filtering and/or transient suppression capabilities for existing data communicating systems and the like.

2. Description of the Prior Art

Electrical circuitry often must be protected from damage caused by power surges owing to electrostatic discharges (ESD) and electromagnetic pulses (EMP). The high voltage generated by ESD and EMP can damage voltage sensitive integrated circuits and the like. Means for protecting against power surges include the use of additional specialized circuitry within equipment, such as voltage variable resistors. Protection can also be achieved by the use of connectors or adapters having transient voltage suppression and filtering devices therein, thereby eliminating the need for costly and extensive modification of the equipment itself.

While it is possible to design a new equipment with specialized circuits for protection from power surges, it is also desirable to provide protection for existing equipment and/or provide protection for sensitive electronic equipment. Often there is a need to interconnect a plurality of pieces of electronic equipment together. The equipment may be wired directly or interconnected through the use of one or more adapters. If the equipment itself does not have protection from power surges, or additional protection is desired, these adapters may be provided with such protection. Adapters with built-in transient suppression device are disclosed in U.S. Pat. Nos. 4,726,638 and 4,799,901.

U.S. Pat. No. 4,726,638 discloses a transient voltage suppression device consisting of a dielectric substrate with a ground surface area on a lower surface thereof, a plurality of transient voltage protectors mounted on an upper surface of the substrate and connected to the ground surface area through apertures in the substrate, and the ground plate attached to the bottom of the jack housing and contacting the ground surface area. The transient voltage suppressions are in the form of diodes and are connected to respective jack contacts via conductive paths on the substrate. The substrate is partially received in the housing to engage with the ground plate, which occupies significant space. Alternatively, the substrate is attached to the bottom of the housing, whereby the height of the modular jack is increased. Furthermore, the ground plate is individually attached to a bottom surface of the housing, which requires modification to the housing according to the specific configuration of the ground plate, thereby complicating manufacture and increasing production cost.

U.S. Pat. No. 4,799,901 issued to Pirc on Jan. 24, 1989 discloses an adapter having transient voltage suppression protection. The Pirc adapter comprises upper and lower housings, a first and second connector subassemblies, a transient voltage suppression members and a grounding shell. The first and second connector subassemblies include, respectively, first and second dielectric support members and first and second terminals. The transient voltage suppression members includes a circuit board having a plurality of electrical circuit components mounted thereon, and grounding strap having grounding legs extending through apertures in the circuit board. It is clearly that the structure of the Pirc adapter is too complicated to be manufactured and assembled.

Hence, an adapter having an improved power surge suppressing device is required to overcome the disadvantages of the prior art.

SUMMARY OF THE INVENTION

An object of the present invention is to provide an improved adapter for interconnecting two or more pieces of electronic equipment while providing protection for that equipment from power surges.

Another object of the present invention is to provide a modular jack having an easily assembled power surge suppressing device.

An electrical adapter includes a first housing member, a second housing member coupled with the first housing member to define an internal space therebetween, and a subassembly received in the space. The first housing member has a first mating face defining a first upper and lower cavities. The second housing member has a second mating face defining a second cavity. The subassembly includes a first, second and third circuit boards, a surge suppressing device, a number of first, second and third conductive terminals respectively mounted on the first, second and third circuit boards, and a number of contact vias electrically interconnecting between the first, second, and third circuit boards. The first, second and third terminals respectively have contacting portions extending into corresponding cavities The surge suppressing device is mounted on the first circuit boards and electrically connects with corresponding first, second and third terminals for transient voltage protection via the contact vias.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which following.

DETAILED DESCRIPTION OF THE INVENTION

Figure 1:
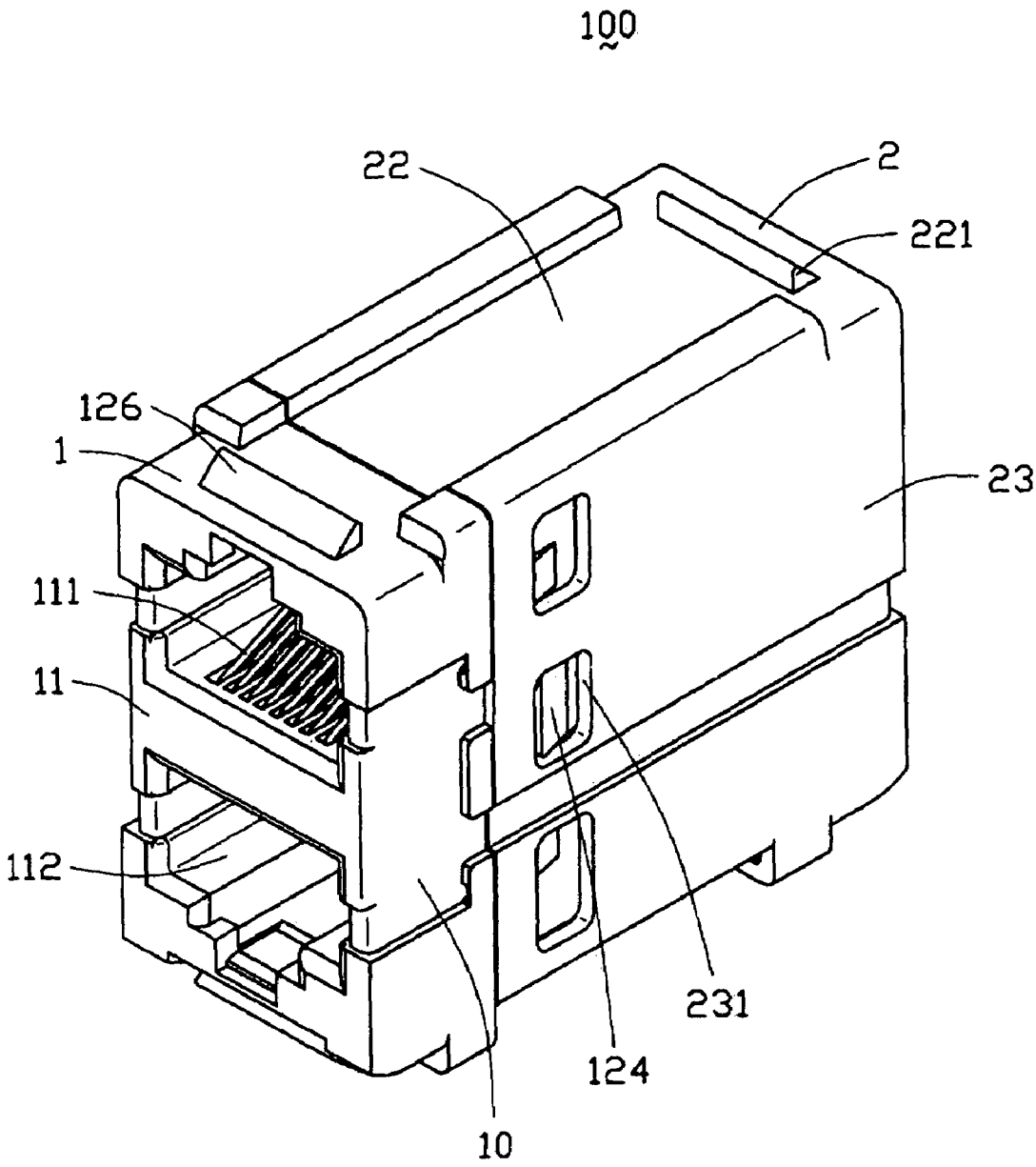
FIG. 1 is a perspective view of an adapter according to the present invention.
Figure 2:
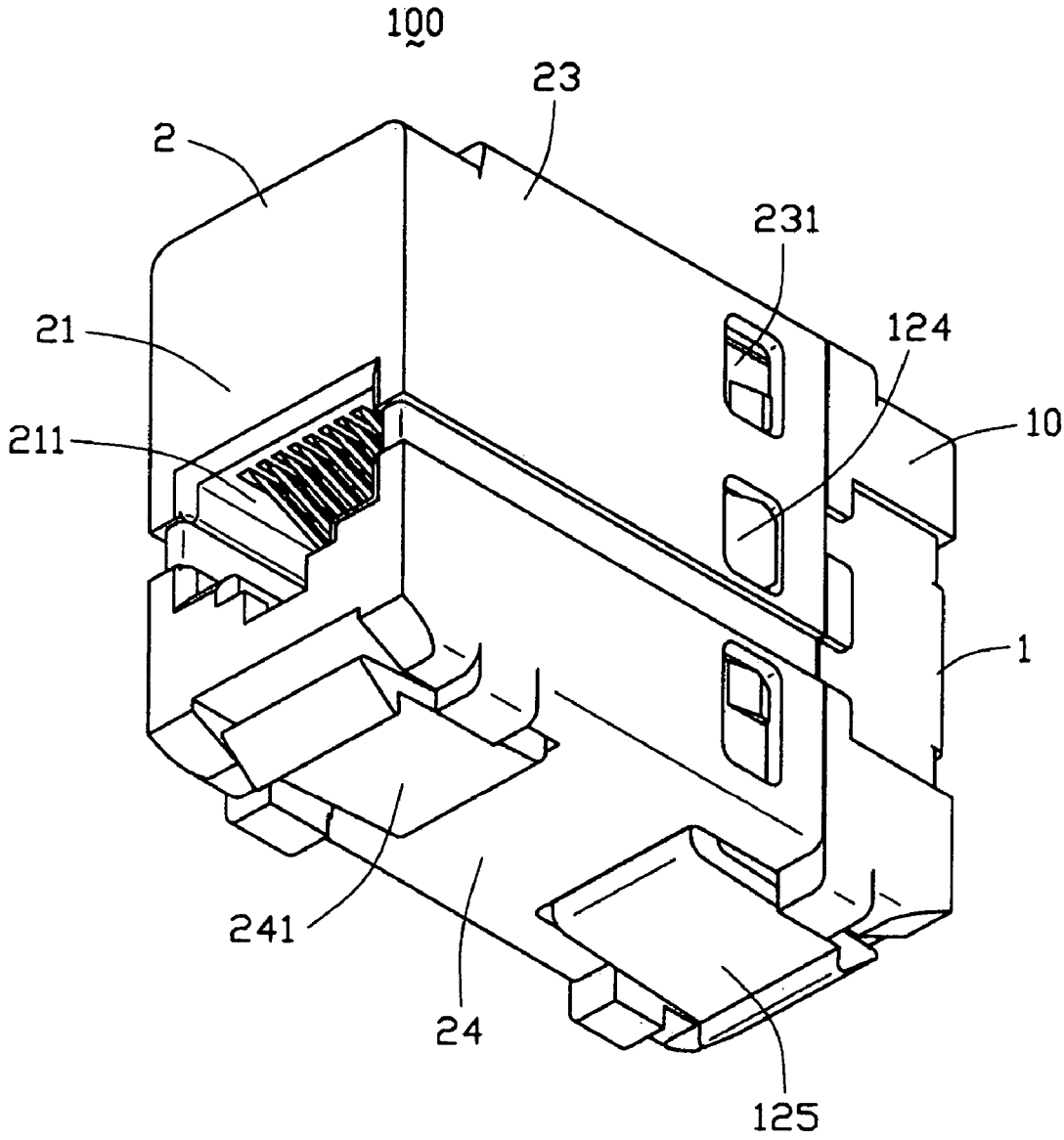
FIG. 2 is another perspective view of FIG. 1.
Figure 3:
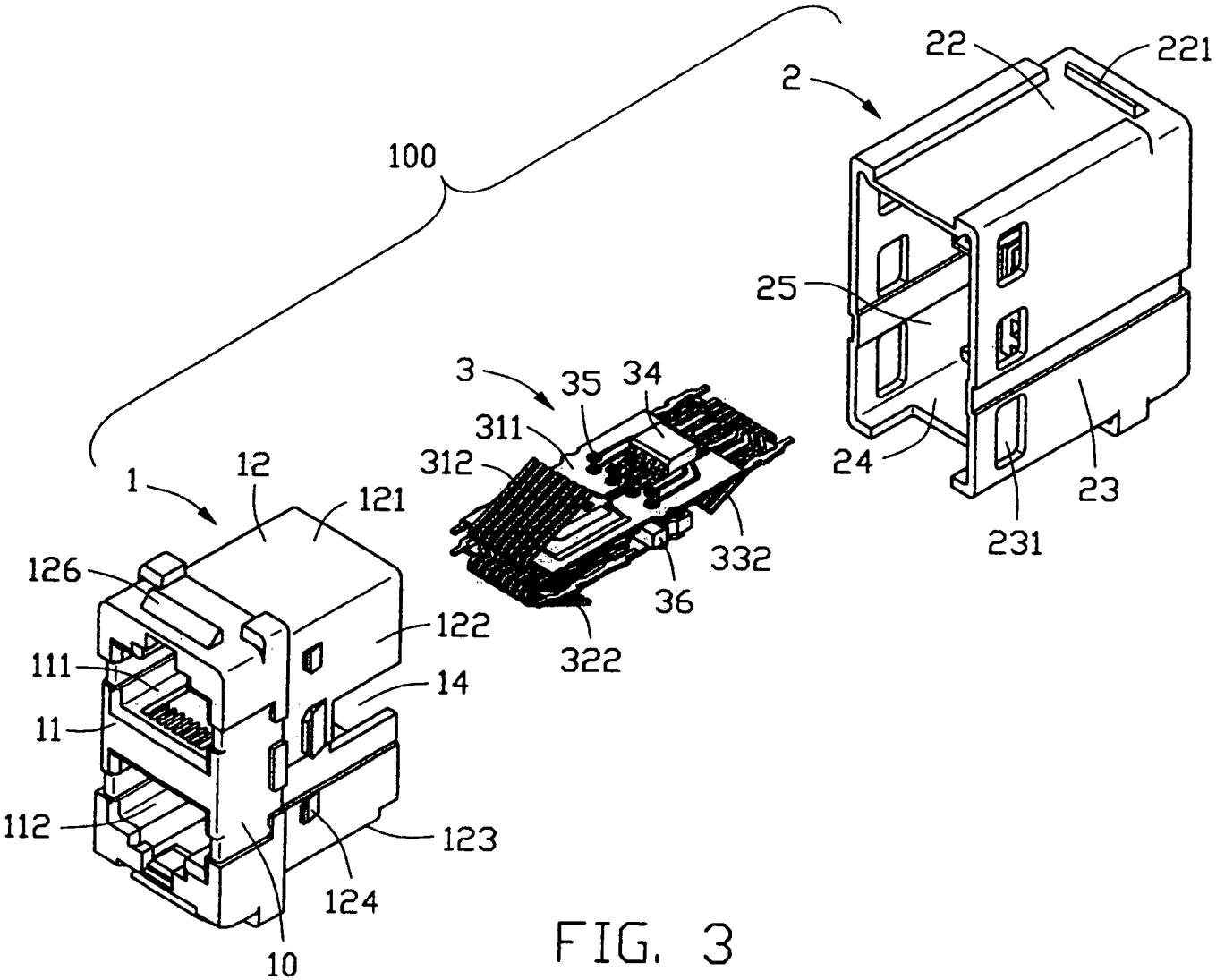
FIG. 3 is an exploded view of FIG. 1.

Referring to FIGS. 1, 2 and 3, an electrical adapter 100 comprises dielectric housing means having a first and second housing members 1, 2 and a subassembly 3 received in the housing means. The first and second housing members 1, 2 are coupled together to define an internal space (not labeled) to receive the subassembly 3 therein. The dielectric housing means have a first and second mating faces 11, 21 each provide first and second receiving cavities 111, 112, 211 extending thereinto for mating with complementary connectors (not shown). The subassembly 3 includes a plurality of conductive terminals 312, 322, 332 and a surge suppressing device 34 mounted thereon. It should be noted that there are only one surge suppressing device shown in this embodiment. However, in some higher power applications, there may be multiple surge suppressing devices used. For purpose of illustration, the adapter 100 is shown as a network coupler having a plurality of modular jacks for particularly connecting between pieces of modular plugs. However, it should be understood that various features of the invention are equally applicable for other types of connectors, as will be fully understandable from the following detailed description.

Figure 4:
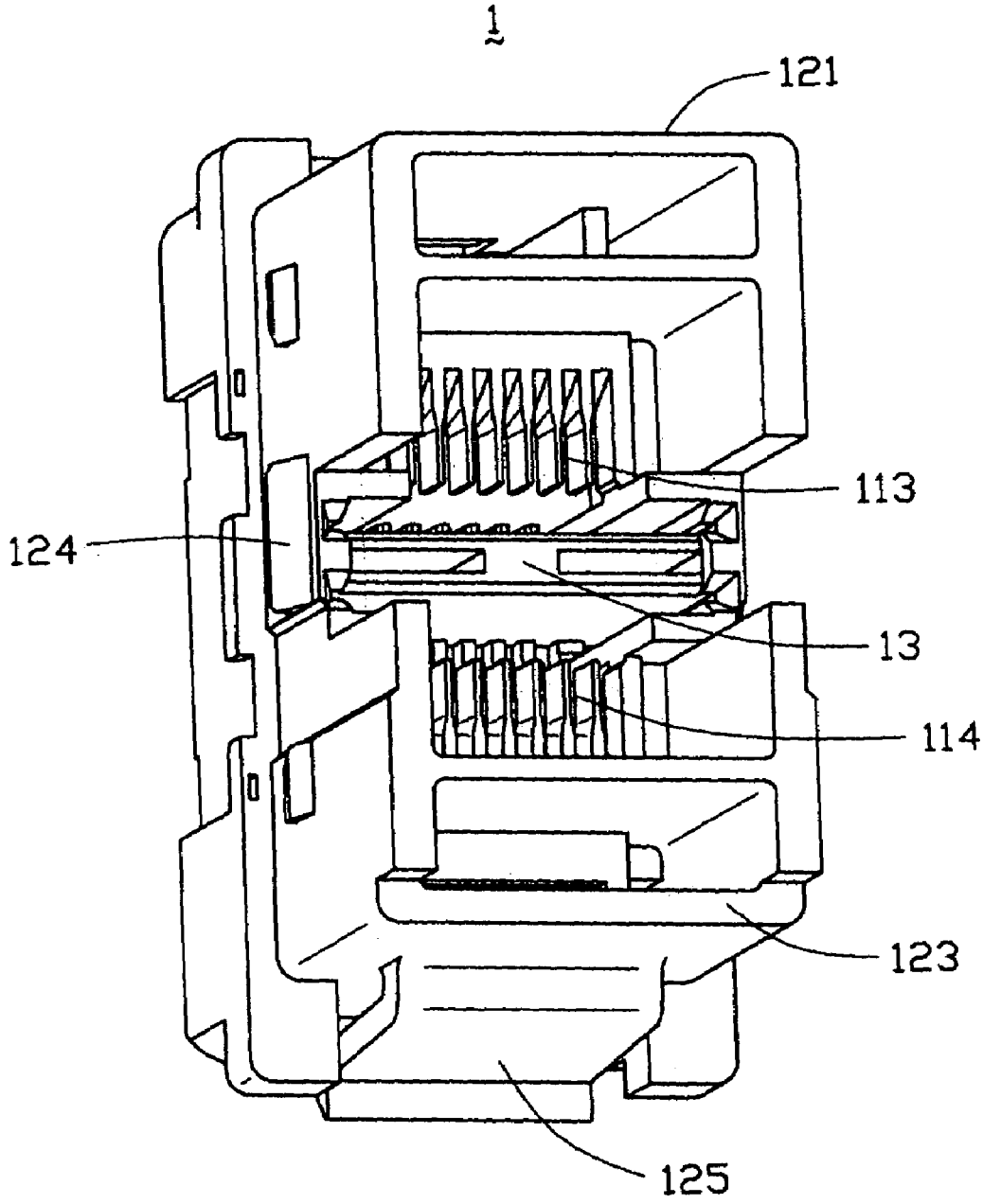
FIG. 4 is a rear, perspective view of a first housing member of the adapter shown in FIG. 3.

Referring to FIGS. 3 and 4, the first housing member 1 is substantially rectangular ladder shaped and includes a front base portion 10 having a front first mating face 11 and a rear coupling portion 12 for engaging with the second housing member 2. The first mating face 11 provides a first upper and lower cavities 111, 112 extending rearwardly thereinto for receiving complementary connectors (not shown) therein. The first upper cavity 111 shares a dividing wall 13 with the first lower cavity 112. The coupling portion 12 comprises a pair of rear sidewalls 122, a rear upper wall 121 connecting with upper portions of the sidewalls 122 and a rear bottom wall 123 connecting with lower portions of the sidewalls 122 to defining a first receiving space 14 therein. Each rear sidewall 122 has a plurality of outwardly projecting locking portions 124 for engaging with the second housing member 2. A plurality of first upper and lower passageways 113, 114 are provided on a respective side of the dividing wall 13, and, respectively, communicating with the first upper and lower cavities 111, 112 and the first receiving space 14. The rear bottom wall 123 provides a first lower latching portion 125 extending downwardly and forwardly toward the first mating face 11. The first lower latching portion 125 includes a planar portion (not labeled) essentially parallel to and spaced from a bottom surface of the rear bottom wall 123, and a downwardly projecting taper portion (not labeled) at a free end thereof. The base portion 10 further has a first upper latching portion 126 extending upwardly from a top surface thereof 10. The first upper and lower latching portions 126, 125 are provided to engaging with counterpart portions of an electrical equipment (not shown) on which the adapter 100 is mounted, thereby securely assembled the adapter to the electrical equipment.

Figure 5:
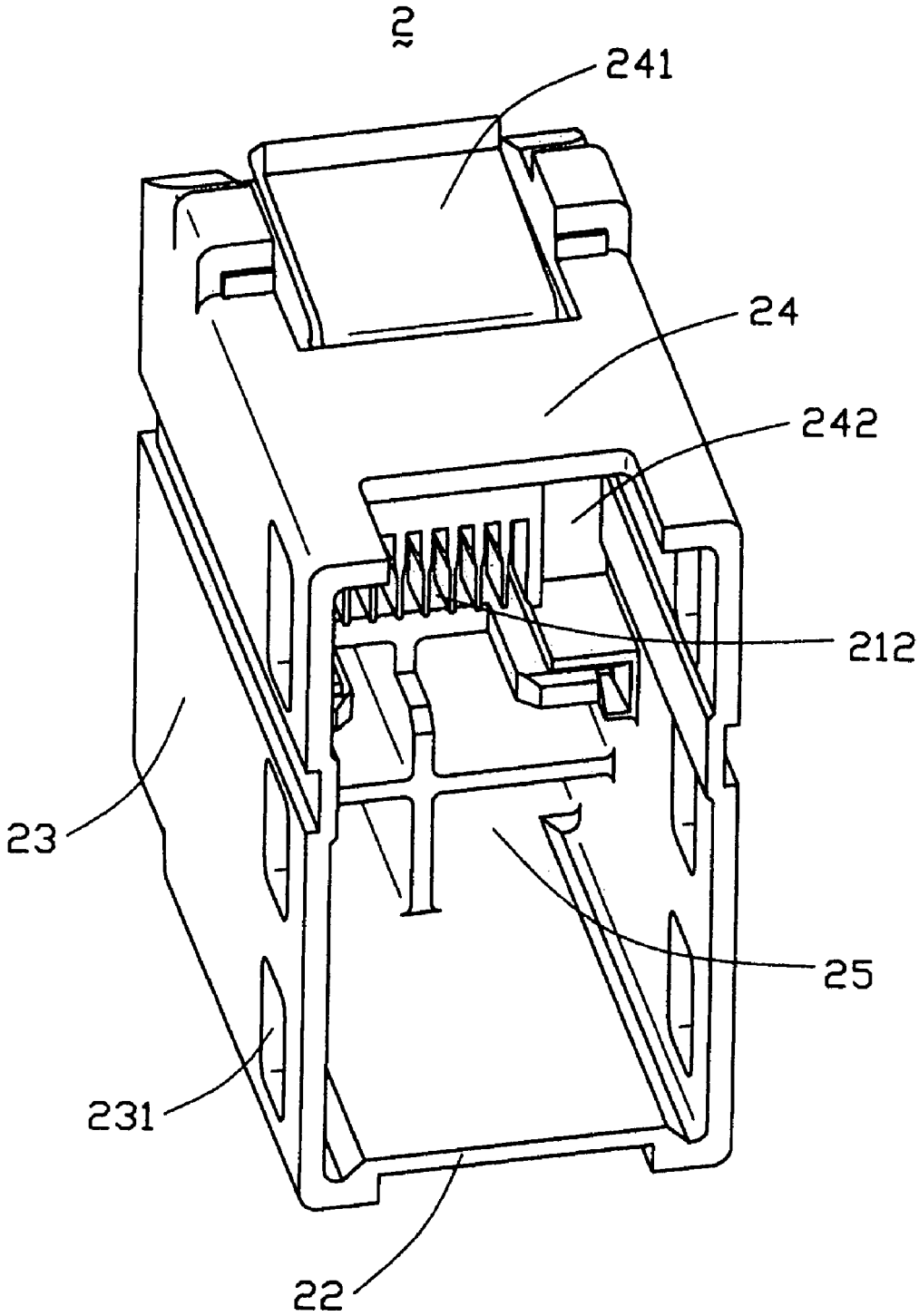
FIG. 5 is a rear, perspective view of a second housing member of the adapter shown in FIG. 3.

Referring to FIGS. 2, 3 and 5, the second housing member 2 includes a second mating face 21 providing a second cavity 211 extending forwardly thereinto, a second upper wall 22, two second sidewalls 23, a second bottom wall 24 and a second receiving space 25. Each second sidewall 23 defines a plurality of locking holes 231 for engaging with corresponding locking portions 124 of the first housing member 1. The second housing member 2 further provides a plurality of second passageways 212 communicating with the second cavity 211 and the second receiving space 25. The second bottom wall 24 includes an opening 242 in a front portion and a second lower latching portion 241 in a rear portion. The opening communicates with the second receiving space 25 for receiving the first lower latching portion 125 of the first housing member 1. The first and second lower latching portions 125, 241 are identical in configuration and structure except that they are oriented to opposite directions. The second upper wall 22 has a second upper latching porting 221 projects upwardly from a top surface thereof. The second upper and lower latching portions 221, 241 are provided to act as a same function with the first upper and lower latching portions 126, 125.

Figure 7:
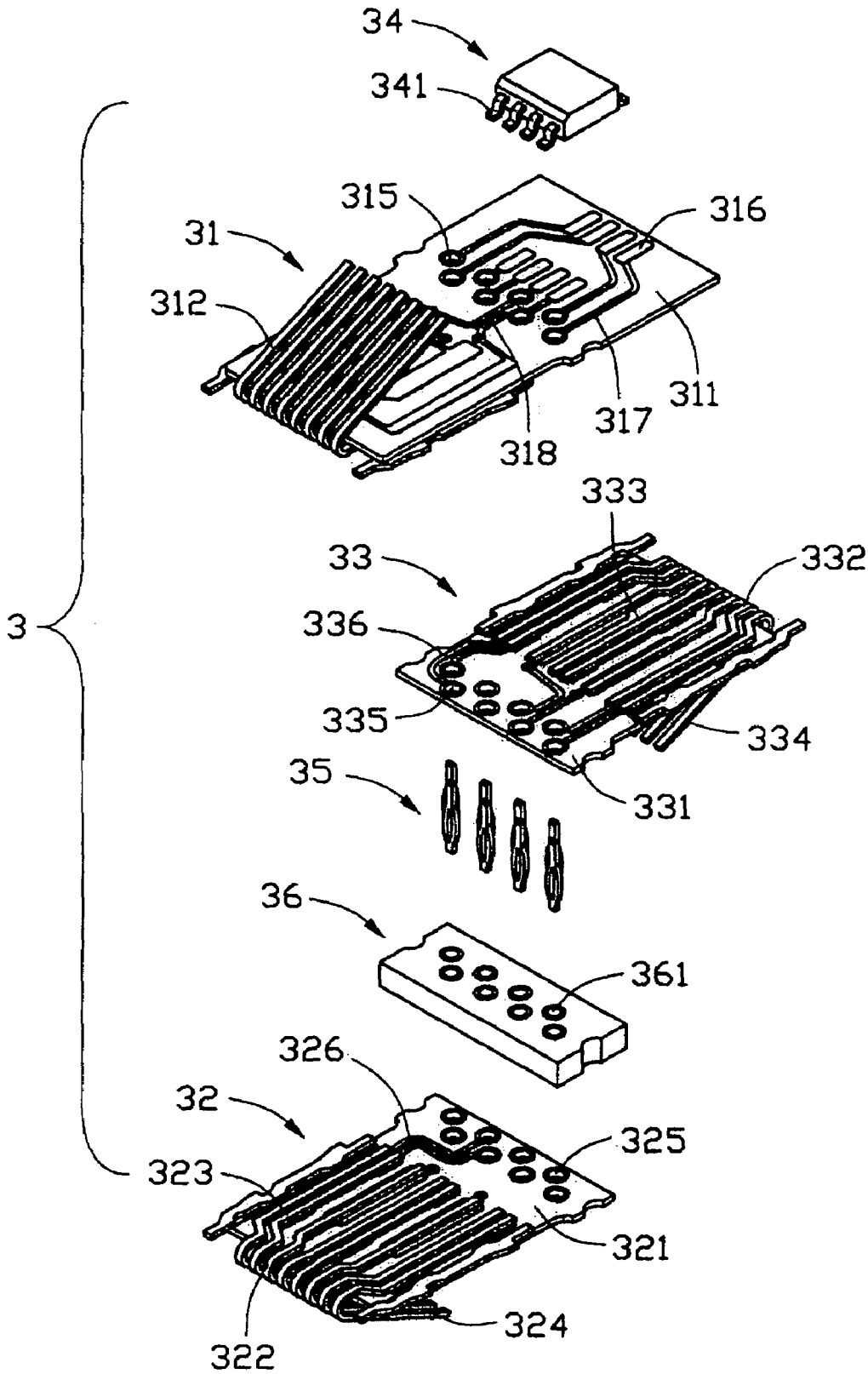
FIG. 7 is an exploded view of the subassembly shown in FIG. 6 taken from top aspect.
Figure 8:
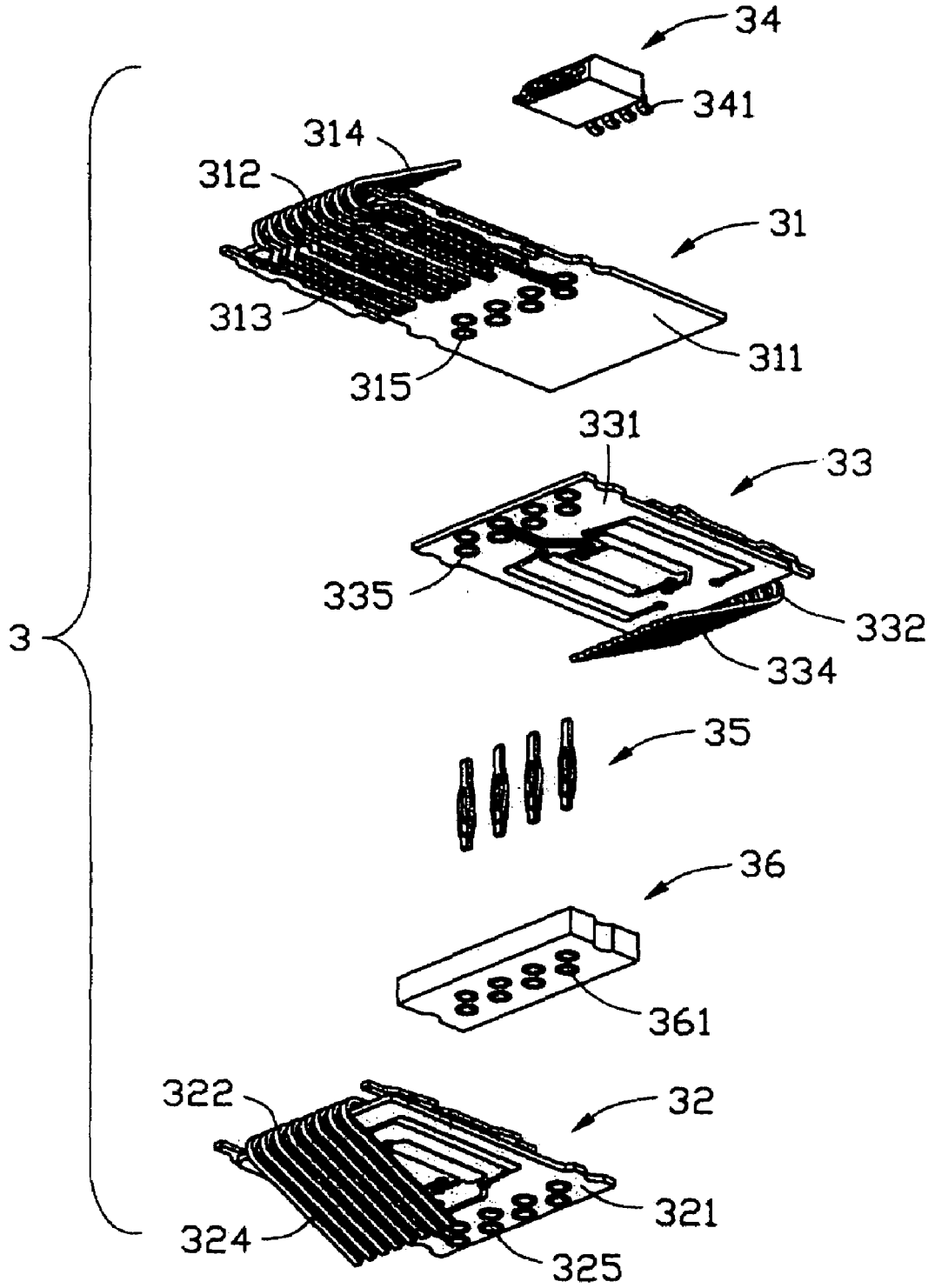
FIG. 8 is another exploded view of the subassembly shown in FIG. 6 taken from bottom aspect.

Referring to FIGS. 7 and 8, the subassembly 3 includes a first, second and third terminal module 31, 32, 33, a surge suppressing device 34 having a plurality of mounting tails 341, a plurality of contact vias 35 and a middle insulator 36 defining a plurality of through holes 361 for receiving corresponding contact vias 35 therein. The first, second and third terminal module 31, 32. 33 respectively include a first, second and third printed circuit board (PCB) 311, 321, 331 and a plurality of first, second and third conductive terminals 312, 322, 332. The middle insulator 36 is dimensioned to be sandwiched between the second and third PCBs 321, 331 to provide a predetermined distance to space the first PCB 311 from the second PCB 321. The first, second and third PCBs 311, 321, 331 comprise, respectively, a plurality of first, second and third circuit traces 318, 326, 336 thereon and a plurality of first, second and third mounting holes 315, 325, 335 through corresponding traces. The first PCB 311 further includes a mounting area 316 and a plurality of mounting traces 317. The mounting area 316 electrically connecting with corresponding mounting holes 315 via the mounting traces 317. Each first conductive terminal 312 includes a first mounting portion 313 soldered to the first PCB 311 and a first contacting portion 314 angled outwardly and rearwardly relative to the first mounting portion 313. Each second conductive terminal 322 comprises a second mounting portion 323 soldered to the second PCB 321 and a second contacting portion 324 angled downwardly and rearwardly relative to the second mounting portion 323. Each third terminal 332 includes a third mounting portion 333 soldered to the third PCB 332 and a third contacting portion 334. The first, second and third terminals 312, 322, 332 respectively electrically connect with first, second and third mounting holes 315, 325, 335 through the first, second, and third circuit traces 318, 326, 336. In this embodiment, the surge suppressing device 34 is substantially a standard module for protecting against voltage surges and is comprised of a bidirectional diode. However, in higher power applications there may be multiple diodes in parallel to accommodate higher current requirements. The structure and the function of the surge suppressing device 34 itself are well known to those skilled in the art, a detailed description is omitted herein.

Figure 6:
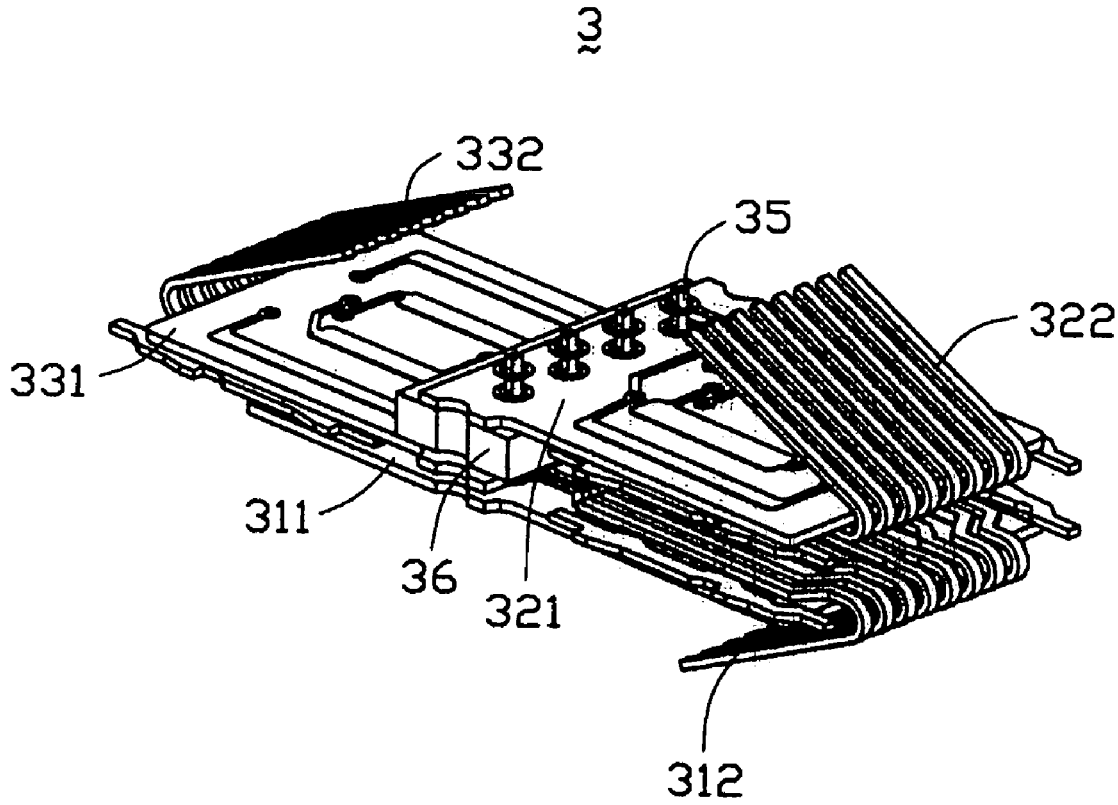
FIG. 6 is a bottom, perspective view of a subassembly of the adapter shown in FIG. 3.

As best shown in FIGS. 2 and 6 in conjunction with FIGS. 7 and 8, in assembly, the first step is to assemble the subassembly 3. The contact vias 35 are press fitted in the through holes 361 of the middle insulator 36 with an upper and lower portion (not labeled) thereof extending beyond the through holes 361. The second terminal module 32 is coupled to a bottom surface of the middle insulator 36, whereby the lower portions of the contact vias 35 extend through corresponding second mounting holes 325 and then be soldered therein. The third terminal module 33 is attached to a top surface of the middle insulator 36. The upper portions of the contact vias 35 extend through corresponding third mounting holes 335 and are soldered therein. The first terminal module 31 is placed over the third terminal module 33 thereafter. The upper portions of the contact vias 35 extend trough corresponding first mounting holes 315 and are soldered therein. Therefore, the contact vias 35 electrically connect with corresponding first, second and third conductive terminals 312, 322, 332 via corresponding first, second and third circuit traces 318, 326, 336.

As best shown in FIGS. 7 and 8, the surge suppressing device 34 is then mounted to the first PCB 311. The mounting tails 341 are soldered to the mounting area 316 of the first PCB 311 and electrically connect with the contact vias 35 through the mounting traces 317. Some of the mounting tails 341 electrically connect with the first terminals 312 via the first circuit traces 318 and the first mounting holes 315, some of the mounting tails 341 electrically connect with the second terminal 322 via some of the contact vias 35 and the second circuit traces 326, and another mounting tails 341 electrically connect with the third terminals 332 via the other contact vias 35 and the third circuit traces 336. Therefore the first, second and third conductive terminals 312, 322, 332 respectively electrically connect with the surge suppressing device 34. The technology of circuitry arrangement is well known to those skilled in the art, a detailed description is omitted herein.

Referring to FIGS. 1 through 6, the subassembly 3 is embedded in the first housing member 1 from a first receiving space 14. The first and second PCBs 311, 321 respectively extend forwardly along a top and bottom surfaces of the dividing wall 13. The first and second conductive terminals 312, 322 extend through corresponding first upper and lower passageways 113, 114 and exposed in a corresponding first upper and lower cavities 111, 112. The second housing member 2 is coupled to the first housing member 1 to form the adapter 100. The second receiving space 25 of the second housing member 2 is placed over the coupling portion 12 of the first housing member 1. The first and second receiving space 14, 25 communicate with each other to defining the internal space. The locking holes 231 of the second housing member 2 lock with the locking portion 124 of the first housing member 1. The third conductive terminals 332 extend through respective ones of the second passageways 212 and extend into the second receiving cavity 211 for mating with the complementary connector (not shown). The first standoff 125 of the first housing member 1 is received in the opening 242 of the second housing member 2.

While terms such "front", "rear", "upper" and "lower" have been used to help describe the invention as it is illustrated, it should be understood that the adapter 100 can be used in any orientation with respect to earth.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

dielectric housing means providing first and second cavities on one end and a third cavity on the other end in a front-to back direction, and a subassembly received in the space of the housing means, the subassembly including first, second and third circuit boards parallel to one another, a plurality of conductive terminals respectively mounted on the corresponding first, second and third circuit bards and having contacting portions disposed in corresponding first, second and third cavities of the housing means, wherein the third printed circuit board is located between said first and second printed circuit boards in a vertical direction, and an orientation of third cavity is same with that of the first cavity in said vertical direction while opposite to that of the second cavity.

2. The adapter as claimed in claim 1, wherein said first and third printed circuit boards essentially extend with only around one half of a dimension of the housing means.

3. The adapter as claimed in claim 1, wherein said second printed circuit board extends with over one half of the dimension of the housing means for providing a surge suppression device thereon.

4. The adapter as claimed in claim 1, wherein an insulator is sandwiched between said first and third printed circuit board.

5. An electrical adapter comprising:

an insulative rectangular housing defining two mating ports on one end and a single mating port at the other end along a front-to-back direction; and three printed circuit boards including associated terminals disposed around the corresponding three mating ports, respectively; wherein one of the two printed circuit boards on said end is longer than the other two printed circuit boards and extends with an additional extended portion toward said other end with a surge suppression device located on, and wherein said additional extended portion is closer to said other end than to said end.

6. The electrical adapter as claimed in claim 5, wherein three printed circuit boards are parallel with one another.

7. The electrical adapter as claimed in claim 6, wherein said other two printed circuit boards on a same side of said longer prited circuit board.

* * * * *